US005084990A

United States Patent [19]

Briscoe

[11] Patent Number: 5,084,990

[45] Date of Patent: Feb. 4, 1992

[54] DRAGLINE BUCKET AND METHOD OF OPERATING THE SAME

[75] Inventor: Terry L. Briscoe, Portland, Oreg.

[73] Assignee: ESCO Corporation, Portland, Oreg.

[21] Appl. No.: 563,393

[22] Filed: Aug. 6, 1990

[51] Int. Cl.[5] ..... E02F 3/46

[52] U.S. Cl. ..... 37/116; 37/135; 37/141 R

[58] Field of Search ..... 37/115, 116, 118 R, 37/135, 141 R, 141 T, 142 R, 142 A, 195

[56] References Cited

U.S. PATENT DOCUMENTS

| | | | |
|---|---|---|---|
| 1,050,838 | 1/1913 | King et al. . | |
| 1,803,654 | 8/1927 | Ronk . | |
| 1,868,246 | 1/1931 | Page . | |
| 2,060,867 | 10/1934 | Hollerbach . | |
| 2,629,945 | 1/1949 | Przybylski . | |
| 2,660,323 | 6/1951 | Carlesimo . | |
| 3,791,054 | 2/1974 | Bierwith . | |
| 4,037,337 | 7/1977 | Hemphill . | |
| 4,791,738 | 12/1988 | Briscoe . | |
| 4,944,102 | 7/1990 | Behlendorf et al. | 37/115 |
| 4,959,915 | 10/1990 | Roussin et al. | 37/118 R |

FOREIGN PATENT DOCUMENTS

| | | | |
|---|---|---|---|
| 306228 | 10/1971 | U.S.S.R. . | |
| 326298 | 3/1972 | U.S.S.R. . | |
| 682605 | 8/1979 | U.S.S.R. . | |
| 708017 | 1/1980 | U.S.S.R. | 1/198 |
| 1121360 | 10/1984 | U.S.S.R. | 37/115 |
| 1305263 | 4/1987 | U.S.S.R. | 37/141 T |

*Primary Examiner*—Dennis L. Taylor
*Assistant Examiner*—Spencer Warnick
*Attorney, Agent, or Firm*—Banner, Birch, McKie & Beckett

[57] ABSTRACT

A dragline bucket and method of operating a dragline bucket wherein a reverse V configuration of teeth is employed to eliminate slewing, i.e., sideways movement when encountering an off-center obstacle.

17 Claims, 2 Drawing Sheets

DRAGLINE BUCKET AND METHOD OF OPERATING THE SAME

BACKGROUND AND SUMMARY OF INVENTION:

This invention relates to a dragline bucket and a method of operating a dragline bucket and, more particularly, to a bucket and method which avoids the problem of slewing by a novel tooth arrangement.

Dragline buckets are a species of excavating buckets which are filled by being dragged over the material or bank to be excavated by means of a dragline and then hoisted by means of a hoisting rope and thereafter dumped. Even as early as 1913, these dragline buckets were well known, see U.S. Pat. No. 1,050,838. A more recent detailed description can be seen in my U.S. Pat. No. 4,791,738.

Over all these years, buckets have slewed, i.e., shifted sideways, when encountering an off center load. This is most pronounced when keying such as cutting along a vertical sidewall or when encountering an off center boulder. I have solved this problem by arranging the teeth in a rearwardly extending V orientation, viz., the teeth project successively forward in proceeding from the longitudinal center line of the bucket toward the sidewalls thereof.

Over the long history of dragline buckets, this arrangement has not been used. The excavator of U.S. Pat. No. 2,060,867 had a reverse V configuration of teeth extending from the rear wall but performed no hoisting and dumping operation. Russian Patent 326,298 also had a reverse V configuration in a dredge but again did not perform the hoisting and dumping functions.

Although reverse V configurations of teeth art known, these have always been employed in buckets whose movement is controlled by dipper sticks or wheels and hence are not subject to slewing. Representative of this type of bucket are U.S. Pat. Nos. 3,791,054, 4,037,337 and Russian Patents 306,228 and 682,605.

A semblance of a forward V configuration is seen in a dragline bucket in U.S. Pat. No. 1,868,246. Other forward V configurations can be seen in U.S. Pat. Nos. 1,803,654, 2,629,945 and 2,660,323 but these, again, are all controlled against slewing by virtue of being rigidly mounted.

According to the invention, I arrange the teeth in a reverse V configuration on the lip of the bucket and advantageously at an angle of about 75° to about 80°, viz., the line connecting a given point on one tooth and a corresponding point on the adjacent tooth forming an angle of about 75° to about 80° to the longitudinal center line of the bucket. Further, I prefer to have the lip generally planar so that the teeth operate in the same plane. With this arrangement, slewing is substantially minimized by virtue of the tooth arrangement directing the obstacle-providing material toward the center of the bucket.

The invention is further described in conjunction with an illustrative embodiment in the accompanying drawing in which FIG. 1 is a fragmentary somewhat schematic view of a conventional dragline bucket and associated prime move showing various features of operation;

FIG. 6 is a fragmentary schematic top plan view showing the practice of the invention when the bucket encounters a boulder or the like.

DETAILED DESCRIPTION

Figure 1:
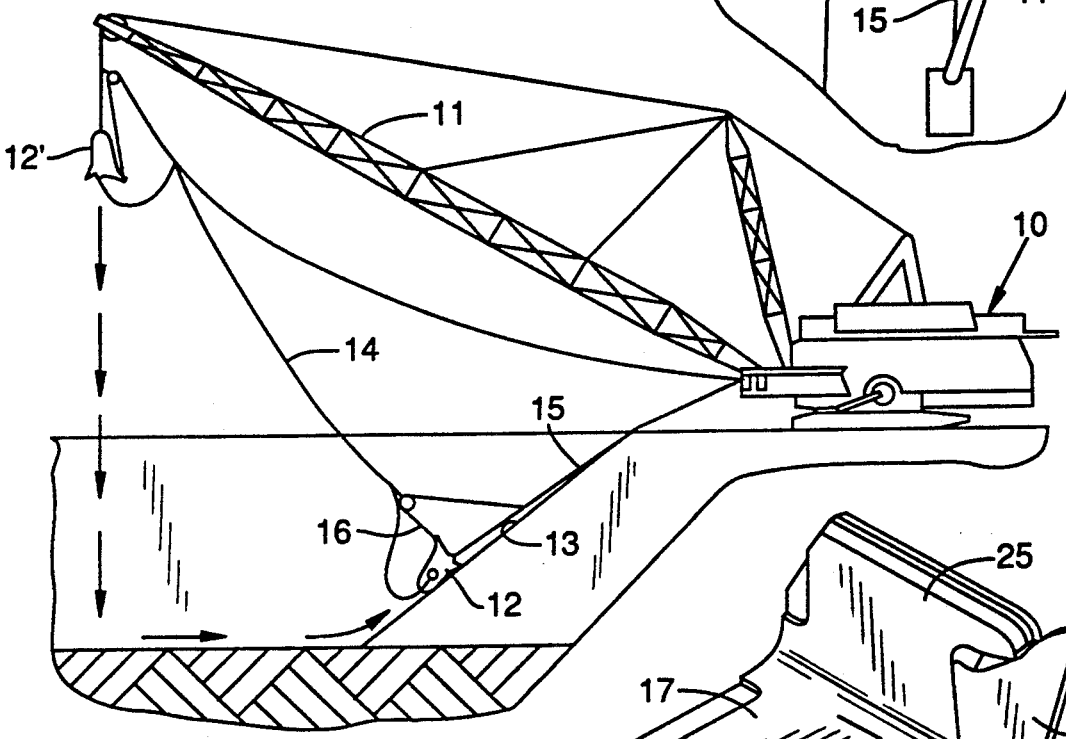

Referring first to FIG. 1, the numeral 10 designates generally a prime mover such as a crawler machine equipped with a boom 11 and other rigging for the operation of a dragline bucket 12 seen removing material from a slope 13. The dumping mode is illustrated in the left of FIG. 1 as at 12'. In conventional fashion, the bucket 12 is equipped with a hoist line 14, a dragline 15 and a dump line 16.

Figure 3:
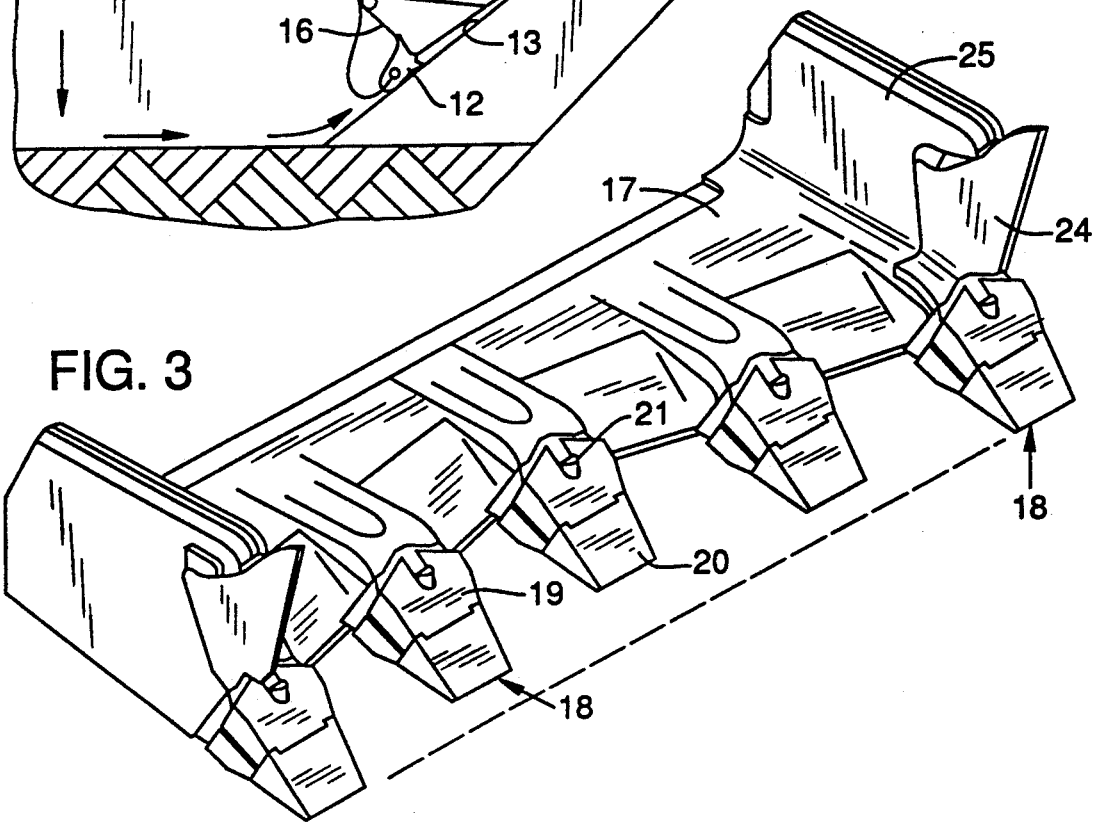
FIG. 3 is a perspective view of a bucket lip featuring the inventive tooth arrangement.

Now referring to FIG. 3 which shows in larger scale the forward end of the bucket 12, the numeral 17 designates a lip which normally is weldably secured to the remainder of the bucket, i.e., the bottom and sidewalls. For additional details of construction, reference may be made to my earlier U.S. Pat. No. 4,791,738 which details the interrelation of the side, rear and bottom walls and open front of a dragline bucket.

Still referring to FIG. 3, the numeral 18 generally designates teeth, five of which are seen disposed across the width of the bucket. These teeth may be of any acceptable construction but normally employ two-piece construction utilizing an adapter 19 and a point 20 secured thereto in temporary fashion by means of a locking pin 21.

Figure 4:
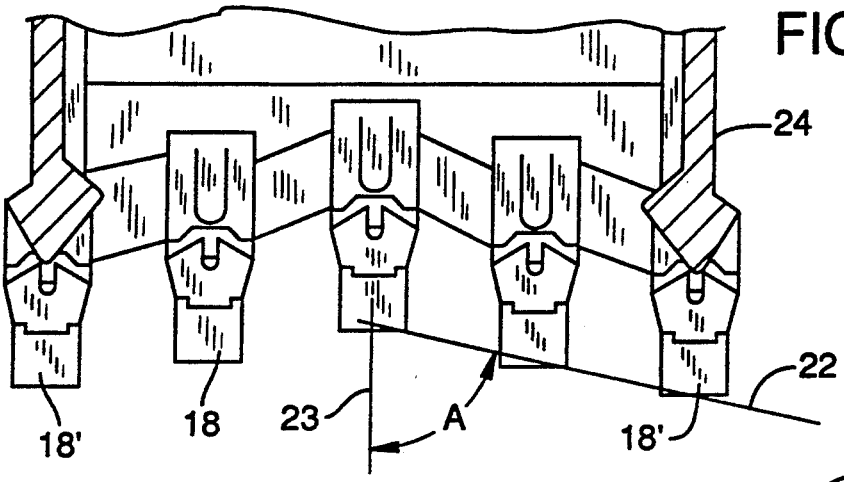
FIG. 4 is a fragmentary top plan view, partially in section, of the forward portion of a bucket utilizing teachings of this invention.

As can be best seen in FIG. 4, the teeth 18 are arranged in a reverse V configuration, i.e., reverse insofar as the direction of advance of the bucket during excavation is concerned. Also as seen in FIG. 4, the teeth are arranged at an angle A of the order of about 75° to about 80°. More particularly, a line 22 connecting a given point on one tooth and a corresponding point on an adjacent tooth forms this angle A to the longitudinal center line 23.

Figure 5:
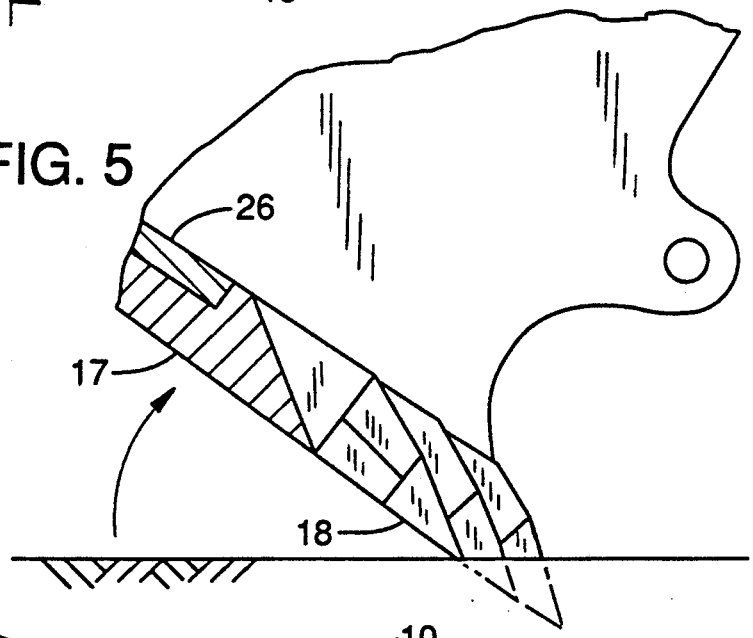
FIG. 5 is a fragmentary side elevational view, partially in section of the bucket of FIG. 4.

The end teeth as at 18' are secured to a portion of the lip equipped with a shroud as at 24 protecting the forward edge of the sidewalls 25 (see FIG. 3). The lip 17 extends forwardly from the bottom wall 26 (see FIG. 5) which bottom wall curves around to form the rear wall as can be appreciated from the showing in FIG. 1.

Figure 2:
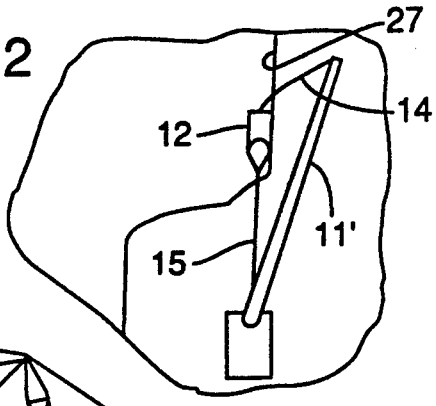
FIG. 2 is a fragmentary top plan view of the apparatus of FIG. 1 showing a conventional bucket keying against a substantially vertical sidewall or bank.

In operation, and with reference to FIG. 2, the bucket 12 is seen to be excavating or keying a portion of a substantially vertical wall 27. With the prior art buckets, it was necessary to "crowd" the bucket against the bank or wall 27 —as by positioning the boom off the bucket longitudinal centerline and over the bank. This is shown in FIGS. 2 at 11'. In such a situation, the bucket "slews", i.e., moves laterally, there being no constraint against this movement as there would be in a shovel dipper or other fixed bucket excavator. In contrast, the practice of the invention avoids the need for "crowding" because the force is distributed differently. More particularly, the most inboard tooth acts as a knife to slice rather than a plane which tends to slew.

Figure 6:
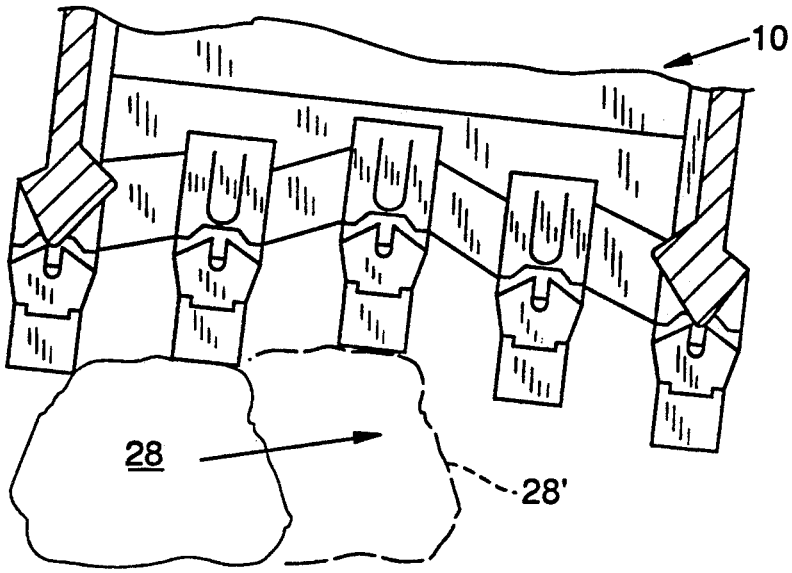

Another advantageous feature of the invention is illustrated in FIG. 6 where the bucket 10 is seen encountering a boulder 28. By virtue of the reverse V configuration, continued pulling force on the dragline 15 causes the boulder to center itself as at 28' and thus again avoids slewing of the bucket A still further advantage accrues from the invention in connection with the bucket described in my earlier U.S. Pat. No. 4,791,738. A dragline bucket with straight-across teeth, when loading difficult material, will tend to tip up on its teeth if the material to load is difficult to penetrate. By the construction of my earlier patent, an increasing pull-to-tip characteristic is provided. By now utilizing the reverse spade lip of the invention, an even greater advantage is developed because, as the bucket tips, the three center teeth come out of a cut—not only putting all of the weight on the teeth but also putting all of the weight on the two corner teeth. This increases the penetration over a straight lip by approximately 150% in the illustration given and provides better stability because the bucket is positioned on the extreme outboard teeth, not tipping on the center teeth which may allow the bucket to fall sideways.

While in the foregoing specification a detailed description of an embodiment of the invention has been set down for the purpose of illustration, many variations in the details herein given may be made by those skilled in the art without departing from the spirit and scope of the invention.

I claim:

1. A method of operating a dragline bucket comprising:

providing a bucket having a body defining side, rear and bottom walls and an open front, said bucket defining a centerline between said side walls, said bottom wall terminating in a forward lip having a generally V-shaped configuration and equipped with excavating teeth, said teeth thereon being laterally spaced apart to define a gap between each pair of adjacent teeth and arranged to project successively forward in proceeding from the longitudinal centerline of said bucket toward said sidewalls;

providing dragline, hoist line and dump line interconnected between said body and a prime mover;

exerting a continuous pulling force on said dragline disposed substantially on said centerline of said bucket to drag the bucket over a material such that said spaced teeth engage and disrupt the material and stably hold the bucket against lateral turning to effectively collect the material in the bucket; and hoisting and dumping said bucket when the bucket is loaded.

2. A method of claim 1, in which said pulling of said bucket includes said bucket engaging a generally vertically band and moving across the face of the bank such that the teeth on only one side of said longitudinal centerline are substantially engaged with the material, said pulling being continuous without substantial crowding and slewing of said bucket.

3. The method of claim 1, in which said pulling of said bucket includes engaging a boulder initially by teeth on only one side of said longitudinal centerline of said bucket, continuing to pull said bucket so that said boulder upon further forward action of said bucket moves centrally of said bucket without said bucket experiencing substantial slewing.

4. The method of claim 1, in which said pulling of said bucket includes continuous pulling when the bucket penetrating the earth begins to tip so that the bucket weight is placed on the teeth most removed from said longitudinal centerline to increase their penetration.

5. The method of claim 1, in which said providing of said bucket includes defining said lip in a generally planar configuration.

6. The method of claim 1, in which said providing of said bucket further includes defining the forward lip such that a line connecting a given point on one tooth and a corresponding point on an adjacent tooth forms an angle of about 75° to about 80° to said centerline of said bucket.

7. A method of operating a dragline bucket comprising:

providing a body having side, rear and bottom walls and an open front, said bucket defining a centerline between said side walls, said bottom wall terminating in a forward lip equipped with excavating teeth, said teeth thereon being laterally spaced apart to define a gap between each pair of adjacent teeth and arranged to project successively forward in proceeding from the centerline of said bucket toward said sidewalls to form an angle of about 75° to about 80° with said centerline;

providing dragline, hoist line and dump line interconnected between said body and a prime mover; and exerting a continuous pulling force on said dragline disposed substantially on said longitudinal centerline of said bucket such that (1) when said bucket engages a generally vertically extending bank so that teeth on only one side of said longitudinal centerline substantially engage material of said bank, said teeth disrupt the material to collect it in the bucket and stably hold said bucket to avoid substantial crowding and slewing of said bucket, (2) when said bucket engages a boulder initially by teeth on only one side of said centerline, said boulder upon said continuous forward pulling of said bucket being directed to move to the center of the bucket without substantial slewing of said bucket, and (3) when said bucket penetrating the earth begins to tip, the bucket weight is placed on the teeth most removed from said longitudinal centerline to increase their penetration.

8. A dragline bucket comprising:

a body including a bottom wall, a pair of side walls and a rear wall, said bottom wall including a forward lip having an inwardly directed, generally V-shaped configuration;

a plurality of teeth secured to said lip at spaced apart locations such that a gap is defined laterally between each pair of adjacent teeth, said teeth each having forward tips which collectively define a generally V-shaped configuration; and means for securing dragline, hoist line, and dump line to said body to operate said dragline bucket for excavation purposes.

9. The dragline bucket of claim 8, in which said forward tips of said teeth are arranged in a generally planar configuration.

10. The dragline bucket of claim 9, in which sections of said lip disposed in said gaps between said teeth each define a sloped surface to collect the material disrupted by the adjacent teeth.

11. The dragline bucket of claim 8, in which sections of said lip disposed in said gaps between said teeth define surfaces which collect the material disrupted by the teeth.

12. The dragline bucket of claim 8, in which said V-shaped lip defines two opposing, generally linear leg portions which diverge at an angle of about 150 to 160 degrees.

13. The dragline bucket of claim 8, in which said V-shaped configuration defined by said collective teeth tips defines two opposed boundaries diverging at an angle of about 150 to 160 degrees.

14. A dragline bucket for use in collecting material by being dragged over the material, said dragline bucket comprising:

a body having a bottom wall, a pair of side walls and a rear wall, said walls cooperatively defining an open front and a cavity for receiving the collected material, said bottom wall including a forward lip forming a bottom boundary for said open front, said body further having an axis extending centrally between said side walls;

a plurality of teeth to engage and disrupt the material as said dragline bucket is dragged along the material, said teeth being secured to said lip at spaced apart locations such that gaps are defined between each pair of adjacent teeth, said gaps exposing portions of said lip to said material so that said lip portions collect the material disrupted by said teeth into said cavity of said body, each said tooth defining a forward tip positioned to project forward a distance greater than the tip of every other tooth located closer to said axis of said bucket so that said teeth tips collectively define a generally concave shape; and means for attaching dragline, hoist line, and dump line to said body to operate said dragline bucket for excavation purposes.

15. The dragline bucket of claim 14, in which said forward tips of said teeth are all positioned generally within the same plane.

16. The dragline bucket of claim 15, in which said tips of said teeth collective define a pair of opposed boundaries diverging at an angle of about 150 to 160 degrees.

17. A dragline bucket comprising a bucket having side, rear and bottom walls and an open front, said body being equipped with drag, hoist and dump lines adapted to be connected to a prime mover, said bottom wall terminating in a forward lip equipped with at least five excavating teeth, said forward lip being generally planar and V-shaped, said teeth being mounted on said lip to project successively forward in proceeding from the longitudinal centerline of said bucket toward said sidewalls to form an angle of about 75° to about 80° with said longitudinal centerline whereby the exertion of a continuous pulling force on said dragline disposed substantially on said longitudinal centerline (1) when said bucket engages a generally vertically extending bank only by teeth on one side of said longitudinal cenertline makes crowding of said bucket unnecessary and slewing of said bucket is avoided (2) when said bucket initially engages a boulder only by teeth on one side of said longitudinal centerline, said boulder upon further forward action of said bucket moves centrally which thereby avoids slewing of said bucket, and (3) when said bucket, in penetrating the earth begins to tip, the bucket weight thereupon is placed on the teeth most removed from said longitudinal centerline to increase their penetration.

* * * * *